US006241469B1

(12) United States Patent
Beeck et al.

(10) Patent No.: US 6,241,469 B1
(45) Date of Patent: Jun. 5, 2001

(54) TURBINE BLADE

(75) Inventors: Alexander Beeck, Küssaberg (DE); Mohamed Nazmy, Fislisbach (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/419,789

(22) Filed: Oct. 18, 1999

(30) Foreign Application Priority Data

Oct. 19, 1998 (DE) ..... 198 48 104

(51) Int. Cl.[7] ..... F01D 5/14

(52) U.S. Cl. ..... 415/115; 415/200; 416/97 R; 416/97 A; 416/229 A; 416/230; 416/241 R

(58) Field of Search ..... 415/115, 116, 415/176, 178, 200; 416/96 R, 96 A, 97 R, 97 A, 229 A, 230, 241 R

(56) References Cited

U.S. PATENT DOCUMENTS

| | | | | |
|---|---|---|---|---|
| 3,647,316 | * | 3/1972 | Galmiche et al. | 427/247 |
| 3,656,863 | * | 4/1972 | De Feo | 416/97 R |
| 3,706,508 | * | 12/1972 | Moskowitz et al. | 415/115 |
| 4,096,296 | * | 6/1978 | Galmiche et al. | 427/247 |
| 4,440,834 | | 4/1984 | Aubert et al. . | |

FOREIGN PATENT DOCUMENTS

| | | |
|---|---|---|
| 2 038 047 | 2/1972 | (DE) . |
| 29 50 150 | 6/1980 | (DE) . |
| 32 03 869 | 8/1983 | (DE) . |
| 3 327 218 | 2/1985 | (DE) . |
| 42 41 420 | 12/1992 | (DE) . |
| 197 34 273 | 2/1999 | (DE) . |
| 2 053 367 | 2/1981 | (GB) . |

OTHER PUBLICATIONS

"Metallisch Hachtemperaturfasern durch Schmelzexratktion–Herstellung, Eigenschaften and Anwendunge", G. Stephani et al., VDI Berichte 1151, 1995, pp. 175–183.
German Patent Office Search Report w/Explanation.

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

Described is a turbine blade with a metal blade body and a protective coating constructed of a porous intermetallic felt, and in the blade body of the turbine blade cooling air channels are constructed that end at the intermetallic felt in order to supply it with cooling air. The intermetallic felt is based on an iron or nickel aluminide alloy with mixing ratios of Fe:Al or Ni:Al of approximately 50:50, and that the protective coating has cooling channels that are facing the blade body and end in the area of the cooling channels. The design of the turbine blades permits their cooling with a smaller amount of cooling air, and, due to improved aerodynamics and a lower cooling air supply, the degree of effectiveness of the turbine is significantly increased.

15 Claims, 2 Drawing Sheets

TURBINE BLADE

BACKGROUND OF THE INVENTION

1. Field of the Invention

The invention relates to a turbine blade with a metal blade body and a protective coating constructed of a porous intermetallic felt, and in the blade body of the turbine blade cooling air channels are constructed that end at the intermetallic felt in order to supply it with cooling air.

2. Brief Description of the Related Art

DE 42 41 420 C1 describes a compressor blade consisting of a titanium alloy that is provided with an abrasive blade armor. The blade armor consists of a nickel matrix with enclosed boron nitride particles. This blade armor is provided preferably at the blade tip.

DE 32 03 869 A1 describes a turbine blade consisting of a basic body (core) of the metal turbine blade and a ceramic hollow body (blade shell). The blade shell is attached with metal retention pins to the turbine blade core. Insulation bodies inserted between the ceramic and metal contact surfaces are intended to reduce the heat flow from the blade shell to the turbine blade core.

DE 29 50 150 A1 introduces a sealing arrangement designed to seal a passage between a rotating and a non-rotating part. The sealing arrangement is provided with a surface seal and an edge part that is located opposite from the surface seal and is attached to the other part. The edge part has teeth that protrude into the surface seal that cut grooves into the surface seal when rotated, so that the seal arrangement forms a labyrinth seal.

The surface seal of this known seal arrangement is composed of metal fibers that form a mat-like or felt-like construction. This material is produced by sintering a matrix of randomly oriented metal fibers at a high temperature and reduced pressure, whereby a completely felted structure of metal fibers is formed which has metal bonds at all contact points of the fibers. The sintered material is characterized by an apparent density that is substantially lower than the density of the fibers themselves. The low density of the sintered fiber material is approximately in the range from 14 to 30%, and in this way these materials differ from sintered, pulverized materials with a density of more than 30%. This type of surface seal was used successfully because it has both the required strength, rigidity, and compactness and is also elastic, and can be comminuted and abraded.

GB 2 053 367 A describes a cooled gas turbine with a shield located opposite from the rotating blades. The shield is formed by a tubular ring with a rectangular cross-section which is able to hold cooling air in its interior. Holes have been provided in the ring wall opposite from the blades, and this wall is provided on the outside with a porous layer through which the cooling air is able to penetrate. The porous layer consists of a material sintered from small spheres. The spheres are constructed of a nickel-based super-alloy.

DE 2 038 047 describes a construction feature on guide vanes that is located inside the flow space of a steam turbine, in particular of saturated and wet steam turbines, and is used to drain water from the surfaces of the individual guide vanes. To reduce or completely prevent the erosion caused by water drop condensation on the surfaces of the turbine blades of wet steam turbines, the guide vane has drainage channels that are filled with porous, liquid-permeable material made from metallic materials or their alloys. The use of porous, liquid-permeable material has as its goal the specific drainage of water from the interior of a steam turbine.

DE 33 27 218 A1 describes a thermally highly stressed, cooled component, in particular a turbine blade, that is coated for reasons of reducing the heat stress with a metal felt layer that again is covered with an additional, ceramic heat insulation layer. In principle, the metal felt layer functions as an elastic carrier material for the ceramic heat insulation layer (see page 4, line 33 to page 5, 2; page 6, 1st paragraph and page 7, lines 2 to 7), but the metal felt layer also has a heat-dissipative action, especially since cooling air is supplied via cooling air grooves 3 (see FIG. 1) to the underside of the metal felt layer in order to cool it locally and in this way achieve an optimum heat dissipation of the heat flowing through the heat insulation layer 6.

With respect to the arrangement of the above quoted publication it can be said that metal felt is applied to the surface of turbine blades for thermal protection, but this protective effect is insufficient to protect the material from which the turbine blades are made from overheating, when the turbine blades encounter high thermal stresses.

SUMMARY OF THE INVENTION

The invention is based on the objective of further developing a turbine blade with a metal blade body and a protective coating constructed from a porous intermetallic felt and in the blade body of the turbine blade cooling air channels are constructed that end at the intermetallic felt in order to supply it with cooling air in such a way that the turbine blade can be cooled better than this is possible with the state of the art. In addition, the degree of effectiveness of the turbine is increased.

The objective is realized by a turbine blade with a protective coating constructed from a porous intermetallic felt and in the blade body of the turbine blade air cooling channels are constructed that end at the intermetallic felt in order to supply it with cooling air.

The turbine blade according to the invention is characterized in that the intermetallic felt is based on an iron or nickel aluminide alloy with mixing ratios of Fe:Al and Ni:Al of approximately 50:50, whereby the ratio here is an atomic ratio. Such a mixing ratio, which is intended to include mixing ratios between 40:60 to 60:40, produces metallic felts with a very slight oxidizability, which, on the one hand, crucially increases the life span of such metallic felts and, on the other hand, preserves their felt structure for a longer time.

In addition to the iron or nickel alloy, additional substances or elements can be added to the respective alloy, for example, Ta, Nb, Cr, B, Si, Zr or Ga. The essential factor in adding additional elements is that the atomic mixing ratio of Fe to Al or Ni and Al remains in the magnitude of 50:50.

In normal felts, oxidative processes, for example, damage the felt structure during its use to such a point that its capacity with respect to cooling air permeability, for example, is crucially reduced. This results in an overheating of the turbine blade.

According to the invention, the protective coating is furthermore provided with cooling channels that are facing the blade body and end in the area of the cooling channels. In this way, it can be ensured that more cooling air additionally flows through the intermetallic felt. This, then, is able to prevent the risk of turbine blade overheating.

In principle, the fact that a porous intermetallic felt is provided on the surface of the blade body does not immediately have as a result that the cooling air introduced into the latter contacts the hot gases of the turbine, but it passes through the intermetallic felt in a gradual manner and is distributed over a larger area. The intermetallic felt, which may have higher surface temperatures than standard materials for turbine blades, is, hereby, cooled in the most intensive manner, whereby the turbine blade, hereby, can be maintained at operating temperature with an extremely small amount of cooling air in comparison to a turbine blade where the cooling air channels exit immediately at the surface. Since the cooling air amount is much smaller because of the better heat transfer, the degree of effectiveness of the turbine is correspondingly increased, since less cooling air is required in the energy supply of the combustor.

The gradual flow of the cooling air through the intermetallic felt has the result that the exit speed of the cooling air at the surface of the turbine blade is very low and does not negatively influence the aerodynamics as was the case previously. This is in particular true if the intermetallic felt is located at the leading edge of the turbine blade, since then, in contrast to standard cooled turbine blades, the flow behavior of the gases impacting the turbine blade is not negatively affected by counter-flowing cooling air.

The cooling channels integrated in the intermetallic felt, which need not necessarily completely pass through the felt layer but only need to penetrate the felt in part, ensure that the protective coating is optimally supplied with cooling air.

Because of the lower cooling air volume and improved aerodynamics, the turbine blade according to the invention permits a significant increase in the degree of effectiveness of a turbine equipped with these turbine blades.

In addition, the intermetallic felt is non-susceptible to mechanical stresses, for example, foreign body impact, since these result only in small, local deformations but do not significantly impair either the function of the cooling system or the basic function of the turbine blade.

BRIEF DESCRIPTION OF THE DRAWINGS

The invention will now be described with reference to the preferred embodiments illustrated in the accompanying drawings, in which like elements bear like reference numerals, and wherein.

DESCRIPTION OF THE PREFERRED EMBODIMENTS

Figure 1:
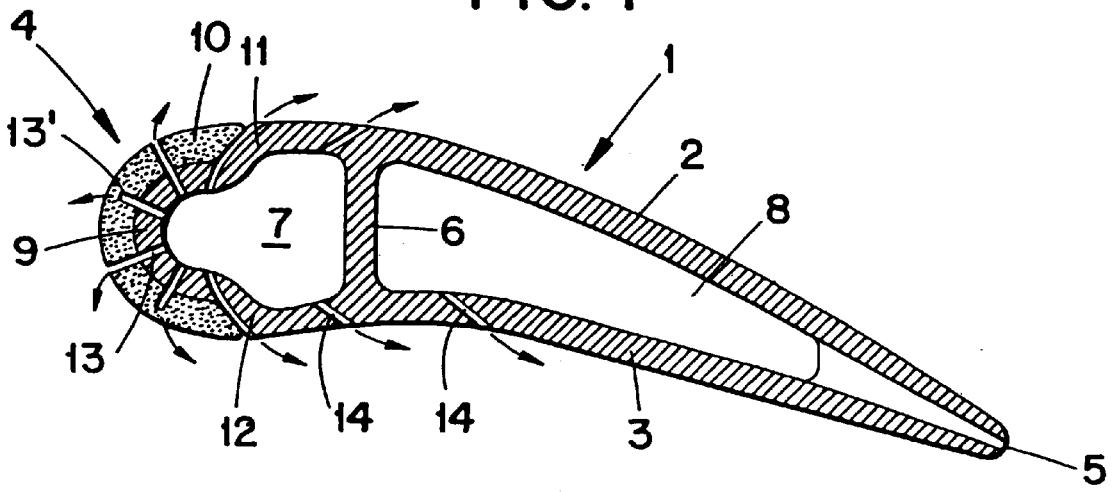
FIG. 1 a cross-section of a turbine blade according to the invention.
Figure 2:
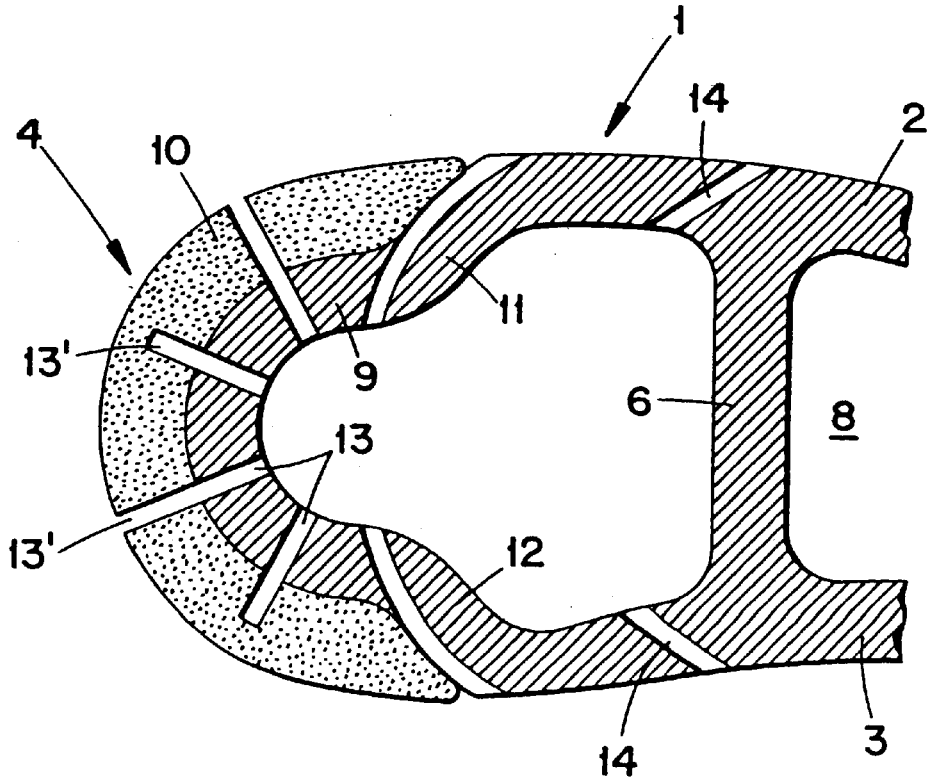
FIG. 2 an enlarged cross-section view of the leading edge part of the turbine blade shown in FIG. 1.
Figure 3:
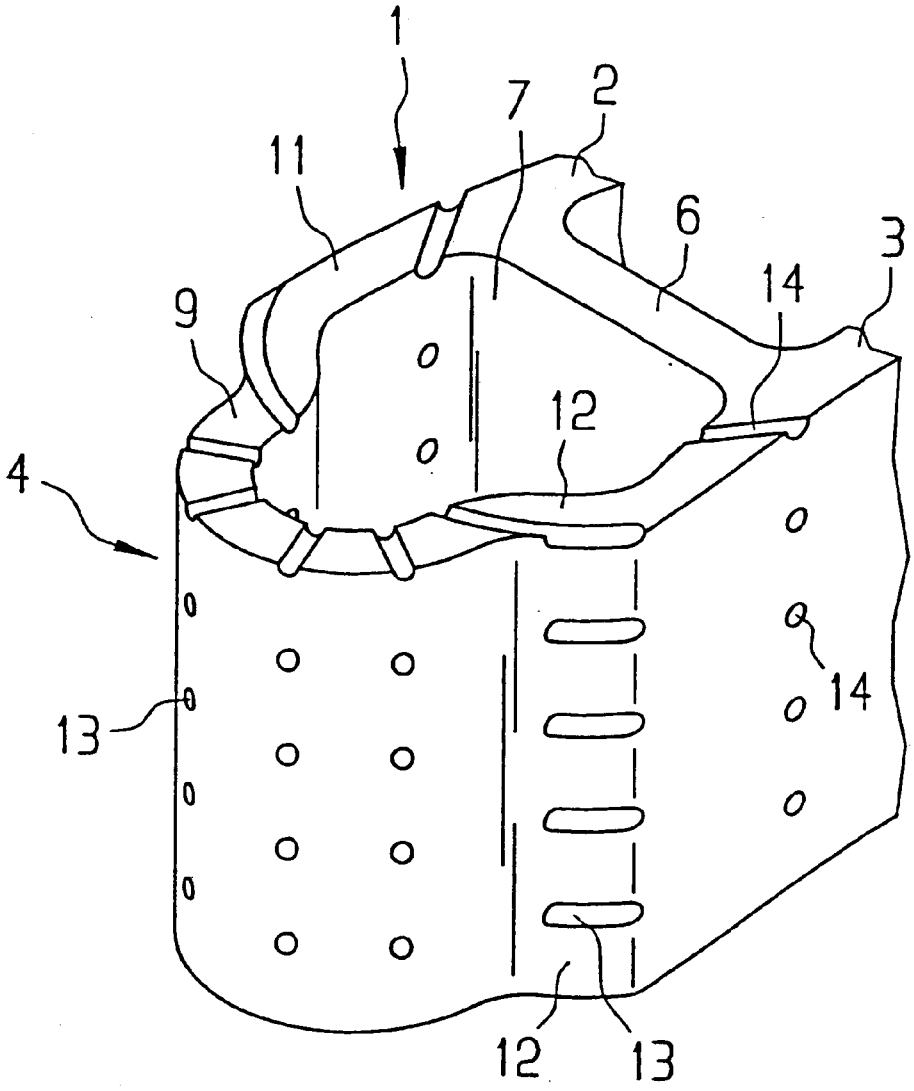
FIG. 3 a perspective view of the leading edge part of the turbine blade shown in FIG. 1 without an intermetallic felt.

FIG. 1 shows a section through a turbine blade 1 according to the invention. The turbine blade 1 has an actually known aerodynamic shape and is constructed of two side walls 2, 3. In the leading edge part 4, the turbine blade 1 has an approximately semi-circular outer surface that ends flush with the outer surfaces of the side walls 2, 3. The side walls 2, 3 converge from the leading edge part 4 into the direction of a trailing edge 5, whereby, they are fixed rigidly to each other in the area of the trailing edge 5. Adjoining the leading edge part 4 with its approximately semi-circular cross-section, a cross-bar 6 is located between the side walls 2, 3 which divides the space between the two side walls 2, 3 into two cooling air channels 7, 8 through which cooling air is supplied to the turbine blade.

The leading edge part 4 of the turbine blade is constructed in two layers, whereby an inner layer is formed by a leading edge part 9 with an approximately ring segment-shaped cross-section and an outer layer formed by a protective coating 10 of intermetallic felt.

The approximately ring segment-shaped leading edge part 9 is connected with the side walls 2, 3 via one each transition part 11, 12. The transition parts 11, 12 form a constricted section that continuously narrows towards the leading edge part.

The two side walls 2, 3, the cross-bar 6, the transition parts 11, 12 and the leading edge part 9 are formed in one piece and made from metal, and form a blade core.

The leading edge part 9 is provided with approximately radially extending cooling bores 13 that end in the cooling channels 13' that project into the protective coating 10. The side walls 2,3 can be provided with additional cooling bores 14 that pass through the side walls 2, 3 so as to extend from the inside at an outward angle towards the trailing edge 5.

The constricted area in the leading edge part 4 forms a recess to hold the protective coating 10 that consists of the intermetallic felt.

In principle, the intermetallic felt consists of a felt-like material, as it is described, for example, in "VDI Bericht 1151, 1995, Metallische Hochtemperaturfasern durch Schmelzextraktion Herstellung, Eigenschaften und Anwendungen, Stephani et al., p. 175 ff.". In that case, fibers are produced using a melt extraction procedure, and the fibers produced in this manner are pressed and sintered. The resulting felt-like material is used as a filter and as a catalyst carrier. According to the invention, this felt-like material is made from intermetallic fibers and is used as a protective coating for a turbine blade. For this purpose, it is preferred that intermetallic iron-based or nickel-based phases are used. According to the invention, the intermetallic felt consists of an iron-aluminum or nickel aluminide alloy with an alloy ratio of the respective two alloy partners of approximately 50:50.

These alloys have a heat resistance, high oxidation resistance, and favorable thermal conductivity properties. The properties are also adjustable over a wide range with the selection of the intermetallic phase.

The protective coating 10 of intermetallic felt is attached by high-temperature soldering in the recess of the turbine blade 1, whereby, the solder has a higher fusion point than the operating temperature of the turbine.

The porosity of the protective coating 10 can be adjusted via the parameters of the production procedures, such as, compression pressure and sinter temperature. This makes it possible to adjust the flow resistance of the protective coating 10 to the respective requirements. The thickness of the protective coating ranges, for example, is from 1–8 mm.

The following explains the function of the turbine blade according to the invention. During operation of the turbine, cooling air is fed through the cooling channel 7 to the leading edge part 9, whereby, the cooling air flows through the bores 13, 13' constructed in the leading edge part outward into the protective coating 10 of intermetallic felt. In the intermetallic felt, the in-flowing air is distributed over a surface area and flows through the felt. The large contact area between the intermetallic felt and the cooling air results in excellent heat transfer properties, so that the predominating heating capacity of the cooling air is used to cool the protective coating 10. In addition, the protective coating 10 consisting of an intermetallic felt acts as a thermal insulator in relation to the blade core.

Compared to standard air-cooled turbine blades, a much smaller amount of cooling air is necessary. Since the relatively small cooling air amount is distributed over a larger surface area when flowing through the protective coating 10, the force with which the cooling air flows from the protective coating is minimal, so that the aerodynamics of the turbine blade are hardly affected.

The invention was explained above in reference to an exemplary embodiment, but the idea of the invention is, hereby, not limited to the exemplary embodiment. Within the constraints of the invention, for example, it is also possible to provide the trailing edge 5 of the turbine blade with a protective coating made from intermetallic felt or to provide a protective coating along the entire surface of the turbine blade. The protective coating can be constructed with a variable thickness and/or variable porosity. The porosity may decrease, for example, from the leading edge part 4 to the trailing edge part 5, so that the intermetallic felt at the leading edge, that is to a larger degree subject to the heat, absorbs more heat than the rest of the area. It may also be useful to vary the porosity along the span.

The intermetallic felt, for example, also may be coated with a corrosion protection layer or a thermal protection layer. For a thermal protection layer, for example, it is possible to use a so-called TBC layer (thermal layer coating) which is typically made from a ceramic base material. The felt is, hereby, able to compensate differences in the thermal expansion behavior of the protective layer and base material because of its plasticity.

Another advantage of the protective coating, according to the invention is that is not susceptible to foreign body damage, i.e., as a rule only local deformities are created which hardly affect the turbine blade function at all.

In the above described exemplary embodiment, the protective coating may even separate during operation, and yet the blade will still be functioning although with a reduced degree of effectiveness.

The turbine blades according to the invention are designed for use in a gas turbine. In particular, the leading edges of the blades of the first turbine guide row should be provided with the protective coating, according to the invention, since they are exposed to the hot gases of the turbine to an especially high degree.

While the invention has been described in detail with reference to the preferred embodiments thereof, it will be apparent to one skilled in the art that various changes and modifications can be made and equivalents employed, without departing from the invention.

What is claimed is:

1. A turbine blade, comprising:

a metal blade body;

a protective coating disposed on the blade body of the turbine blade, the protective coating constructed from a porous intermetallic felt;

the blade body of the turbine blade including cooling air channels ending at the intermetallic felt in order to supply the intermetallic felt with cooling air, wherein the intermetallic felt is based on an iron or nickel aluminide alloy with mixing ratios of Fe:Al or Ni:Al of approximately 50:50, and that the protective coating has cooling channels that are facing the blade body.

2. The turbine blade as claimed in claim 1, characterized in that the iron or nickel aluminide alloy contains additional substances of Ta, Nb, Cr, B, Si, Zr or Ga.

3. The turbine blade as claimed in claim 1, wherein cooling channels are provided that completely pass through the protective coating.

4. The turbine blade as claimed in claim 1, wherein cooling channels are provided that only partially penetrate into the protective coating.

5. The turbine blade as claimed in claim 1, wherein a leading edge of the blade body is provided with the intermetallic felt.

6. The turbine blade as claimed in claim 1, wherein a trailing edge of the blade body is provided with the intermetallic felt.

7. The turbine blade as claimed in claim 1, wherein the blade body has in the area provided with the intermetallic felt a recess in which the intermetallic felt is arranged in such a way that it ends flush with the adjoining area of the blade body.

8. The turbine blade as claimed in claim 1, wherein the entire blade body is coated with the intermetallic felt.

9. The turbine blade as claimed in claim 1, wherein the intermetallic felt is constructed of pressed-together and sintered intermetallic fibers.

10. The turbine blade as claimed in claim 9, wherein the intermetallic fibers are constructed of an intermetallic iron-based or nickel-based phase.

11. The turbine blade as claimed in claim 1, wherein fibers of the intermetallic felt are coated.

12. The turbine blade as claimed in claim 11, wherein fibers of the intermetallic felt are coated with a corrosion protection layer and/or a thermal protection coating.

13. The turbine blade as claimed in claim 1, wherein the turbine blade is arranged at the rotor of a turbomachine.

14. The turbine blade as claimed in claim 12, wherein the turbine blades arranged in a first guide row are provided with the protective coating intermetallic felt.

15. The turbine blade as claimed in claim 13, wherein the turbomachine is gas turbine.

* * * * *